US008403185B2

(12) United States Patent
Vachon

(10) Patent No.: US 8,403,185 B2
(45) Date of Patent: Mar. 26, 2013

(54) AUTO-VENTED AUTOMATIC STOP FLOW POURING SPOUT

(76) Inventor: Leandre Vachon, Thetford Mines (CA)

( * ) Notice: Subject to any disclaimer, the term of this patent is extended or adjusted under 35 U.S.C. 154(b) by 291 days.

(21) Appl. No.: 12/677,863

(22) PCT Filed: Sep. 10, 2008

(86) PCT No.: PCT/CA2008/001605

§ 371 (c)(1),
(2), (4) Date: Jul. 5, 2010

(87) PCT Pub. No.: WO2009/033277

PCT Pub. Date: Mar. 19, 2009

(65) Prior Publication Data

US 2010/0308085 A1 Dec. 9, 2010

(30) Foreign Application Priority Data

Sep. 12, 2007 (CA) ..... 2601607

(51) Int. Cl.
*B67D 3/00* (2006.01)

(52) U.S. Cl. ..... 222/484; 222/153.01; 222/153.14; 222/481.5; 222/523; 222/539; 222/566; 222/568; 141/309

(58) Field of Classification Search ..... 222/481.5, 222/484, 522–523, 566–568, 518, 525, 153.05, 222/153.01, 153.06, 153.07, 153.14, 539; 141/309, 311 R, 319–322, 351
See application file for complete search history.

(56) References Cited

U.S. PATENT DOCUMENTS

| | | | | |
|---|---|---|---|---|
| 4,746,036 | A | 5/1988 | Messner | |
| 4,958,668 | A * | 9/1990 | Vachon | 141/291 |
| 5,507,328 | A | 4/1996 | Donovan | |
| 5,560,522 | A * | 10/1996 | Clark | 222/481.5 |
| 6,155,464 | A * | 12/2000 | Vachon | 222/484 |
| 6,722,535 | B1 | 4/2004 | Flach | |
| 7,128,108 | B2 * | 10/2006 | Nielsen | 141/351 |
| 7,621,304 | B2 * | 11/2009 | Nielsen | 141/351 |
| 2004/0035895 | A1 | 2/2004 | Schliemann et al. | |
| 2005/0092783 | A1 | 5/2005 | Nielsen | |

FOREIGN PATENT DOCUMENTS

| | | |
|---|---|---|
| CA | 2381533 | 3/2001 |
| EP | 0112938 A2 | 7/1984 |
| EP | 0569222 A1 | 11/1993 |
| EP | 0580416 A1 | 1/1994 |
| WO | 9633102 A1 | 10/1996 |

* cited by examiner

*Primary Examiner* — Frederick C. Nicolas
(74) *Attorney, Agent, or Firm* — IPAXIO S.E.N.C.

(57) ABSTRACT

The pouring spout has an inlet tube detachably connectable to a liquid-storage container and an outlet tube slideably connected to the inlet tube. A liquid duct and an air duct are defined into the inlet tube and the outlet tube. A valve system is provided for opening the liquid duct and the air duct when the outlet tube is slideably moved relative to the inlet tube. The liquid duct and the air duct open separately into the liquid-storage container. When pouring, the liquid flows through the liquid duct and air separately enters into the liquid-storage container via the air duct.

15 Claims, 22 Drawing Sheets

AUTO-VENTED AUTOMATIC STOP FLOW POURING SPOUT

CROSS-REFERENCE TO RELATED APPLICATIONS

This application is a National Stage of International Patent Application No. PCT/CA2008/001605, filed on Sep. 10, 2008, which claims priority to foreign Patent Application No. CA 2,601,607, filed on Sep. 12, 2007.

BACKGROUND OF THE INVENTION

The present invention relates to an auto-vented automatic stop flow pouring spout optionally provided with a childproof protection, which can be used on various types of containers to pour the liquid contained in these containers into receiving containers or tanks, with a minimum risk of accidental spill and/or evaporation.

BRIEF DESCRIPTION OF THE PRIOR ART

Pouring spouts connectable to containers in order to fill up other containers or tanks with liquids while reducing to a minimum the risks of spillage are already known. By way of example, reference can be made to Canadian Patent No. 2,381,533 issued on Aug. 10, 2004, with designation by the same inventor and to its US counterpart U.S. Pat. No. 6,155,464.

SUMMARY OF THE INVENTION

The present invention is actually an improvement to the basic structure of the pouring spout disclosed in the above-mentioned patents.

More specifically, the present invention is directed to a pouring spout of the type comprising:

- an inlet tube devised to be detachably connectable to the container for receiving the liquid stored therein;
- an outlet tube slideably connected to the inlet tube for guiding the liquid from the inlet tube to a receiving container;
- a liquid duct that is part of both of said inlet tube and outlet tube and through which the liquid stored in the container can flow;
- an air duct that is also part of both of said inlet tube and outlet tube and through which air can come freely inside the container, such considerably reducing vacuum formation within the container and allowing faster liquid transfer through the liquid duct;
- a valve system for simultaneously opening the liquid duct and the air duct when the outlet tube is slideably moved relative to the inlet tube; and
- an internal spring to keep the inlet and outlet tubes in such a position with respect to each other as to keep the valve system closed unless a pressure is applied to the outlet tube in order to slideably move it relative to the inlet tube.

In accordance with the invention, the pouring spout is characterized in that its valve system is devised so as to cause the liquid duct and the air duct to open separately into the storing container.

Thanks to its structure, the valve system used in accordance with the invention, allows the liquid stored in the container to flow freely out of the same through the liquid duct, and air to separately enter into the container via the air duct, thereby preventing any interference.

Of course, the valve system is devised to allow the outlet of liquid and the air entrance to close at the same time.

The valve system used in accordance with the invention also permits to achieve a faster flow even when the pouring spout has a smaller outlet, such allowing the pouring spout to be used in limited areas or to fill a car or a small tank.

Moreover, the valve system permits to obtain a reduction of evaporation by reducing to a minimum, the materials in contact with the liquid stored in the container.

In one particularly preferred embodiment of the invention, the outlet tube is slideably mounted externally onto the inlet tube and the valve system consists of a single piece of elongated form that is slideably mounted internally within the inlet tube, said piece having one end that is rigidly connected to the outlet tube so as to be moved with it relative to the inlet tube and that is divided into several longitudinal sections by means of radial walls so as to complete the liquid duct and the air duct of the outlet tube, said piece also having an opposite end shaped so as to act as a closing wall, said other end having a portion that is in line with the air duct and being of an angled hollow shape and provided with a narrow rectangular opening that permits a clear gradual opening of the air duct separately from the opening of the liquid duct when the piece is pushed by the outlet tube within the container in order to open it.

In another particularly preferred embodiment of the invention, the outlet tube is slideably mounted externally onto the inlet tube and the valve system consists of a bascule valve pivotably mounted at an extremity of a holding tube that is part of the outlet tube and is devised so as to extend within the inlet tube and to act as part of said air duct and as a support and a guide for the internal spring of said pouring spout, said holding tube passing through a holding ring that is part of the inlet tube and devised so as to retain the internal spring, the bascule valve being mounted onto the holding tube by means of a support that is part of said bascule valve and is provided with a U-shaped recess which is positioned so as to be in line with the holding tube and thus to allow and control air entrance within the container when the pouring spout is activated, the bascule valve in closed position extending fully across the inlet tube and thus preventing both air and liquid from passing into the inlet tube, said inlet tube and said bascule valve comprising stoppers positioned so as to guide and stop said bascule valve in closed position.

In accordance with a further particularly preferred embodiment of the invention the outlet tube is slideably mounted internally within the inlet tube and comprises an inlet portion which is devised so as to act as said valve system, said inlet portion comprising a valve head that externally projects from said inlet portion so as to come into contact with the outlet tube when the pouring spout is closed, said valve head being also closed by an end wall, so as to complete the closing of the pouring spout, said inlet portion acting as said valve system also comprising a hole made into the outlet tube close to the valve head so as to give separate access to the air duct integrated to said outlet tube and one or more other holes also made close to the valve head so as to give access to the liquid duct also integrated to said outlet tube, said holes opening the air duct and liquid duct when the outlet tube is pushed back within the inlet tube.

As can be appreciated, thanks to its structure, the pouring spout according to the invention is not only very effective but also not expensive and of high quality.

The invention and its advantages will be better understood upon reading the following non-restrictive description of the three preferred embodiments thereof, made with reference to the accompanying drawings.

DETAILED DESCRIPTION OF THREE PREFERRED EMBODIMENTS OF THE INVENTION

Figure 1A:
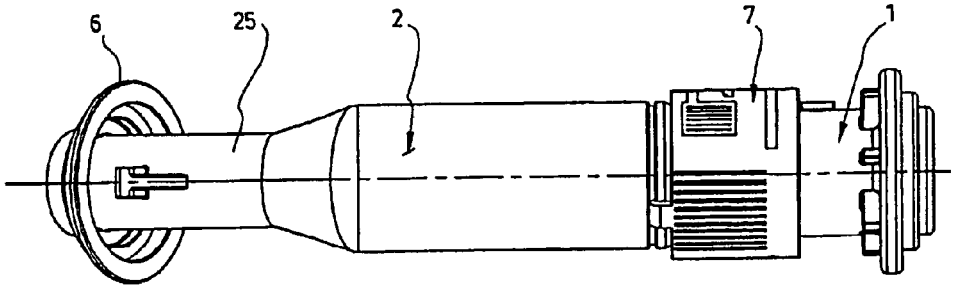
FIGS. 1*a*, 1*b*, and 1*c* illustrate a pouring spout according to a first preferred embodiment of the invention, hereinafter also called Model LV-06, wherein said pouring spout is shown in closed position.
Figure 1B:
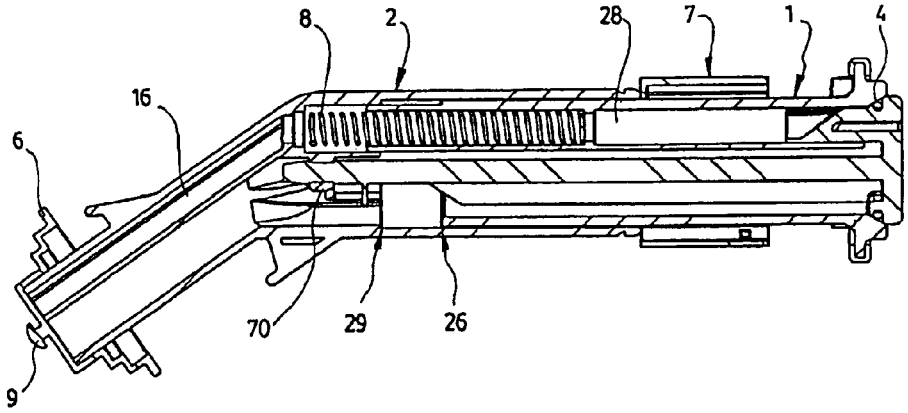

In the three preferred embodiments of the invention illustrated in the accompanying drawings, the pouring spout comprises an outlet tube 2, 11, 93 provided with an outlet exit portion 25, 27 94, which is itself provided with a separate internal air duct 16, 17, 105 devised to let air pass through it directly inside the container to which the pouring spout is connected. The outlet tube 2, 11, 94 comprises a spring 8, 18, 96 acting as a closing element. Teeth 21, 22, 23, 24 and 92 are provided onto the outlet tube in order to facilitate the opening of the pouring spout when it is pressed against the neck of another container or tank to be filled. These teeth also help to support the weight of the container to which the pouring spout is connected while filling the other container or tank. The outlet exit portion 25, 27, 93 of the pouring spout advantageously has a small diameter and may optionally extend at an angle of 90° (about 30° in the first and second illustrated embodiments) in order to facilitate its insertion into the other container or tank to be filled, while allowing the user to see inside this other container or tank. Such advantageously prevents spillage and ensures more security.

In the three preferred embodiments of the invention, the pouring spout also comprises an inlet tube 1, 10, 91 to which the outlet tube 2, 11, 93 is slideably connected. The inlet tube 1, 10, 91 is devised for use to connect the pouring spout to the type of container to which it is intended to be connected.

The inlet tube 1, 10 of the pouring spout according to the first and second preferred embodiments of the invention has an external surface provided with projections and/or grooves 19, 20, 53, acting as guides, locks and/or retainers. The purpose of these projections and/or grooves is to allow positioning and locking a childproof security system 7, to hold back the spring of the valve system as will be explained hereinafter, and to prevent the inlet and outlet tubes from turning one upon the other. More specifically, and as is illustrated, the projections or grooves are provided to prevent the outlet tube 2, 11, to turn around the inlet tube 1, 10.

Figure 1C:
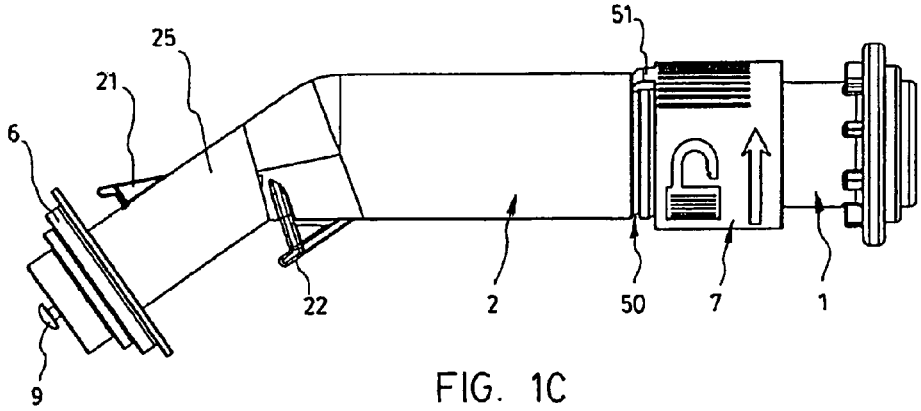
Figure 2A:
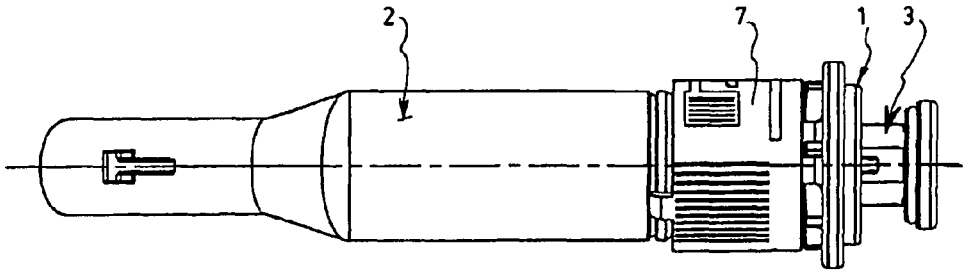
FIGS. 2*a*, 2*b*, and 2*c* are views similar to those of FIGS. 1*a*, 1*b*, and 1*c*, but with the pouring spout shown in open position.
Figure 2B:
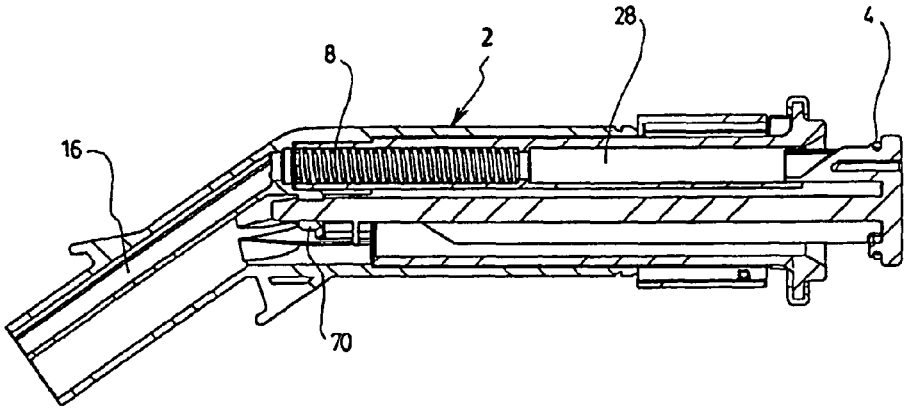
Figure 2C:
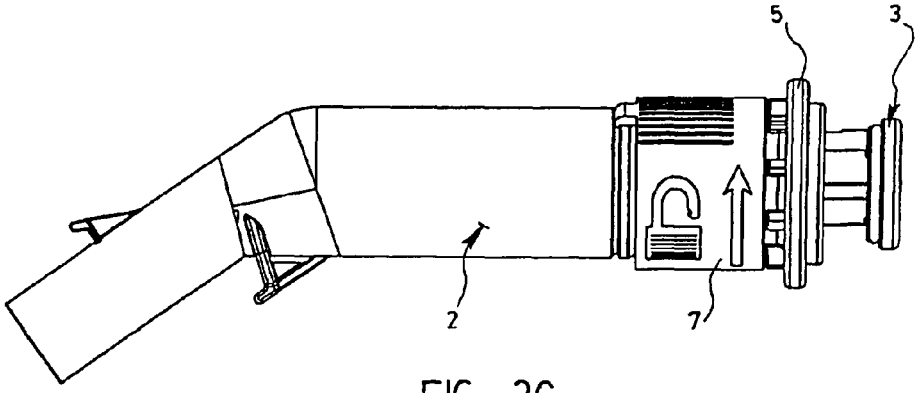
Figure 3A:
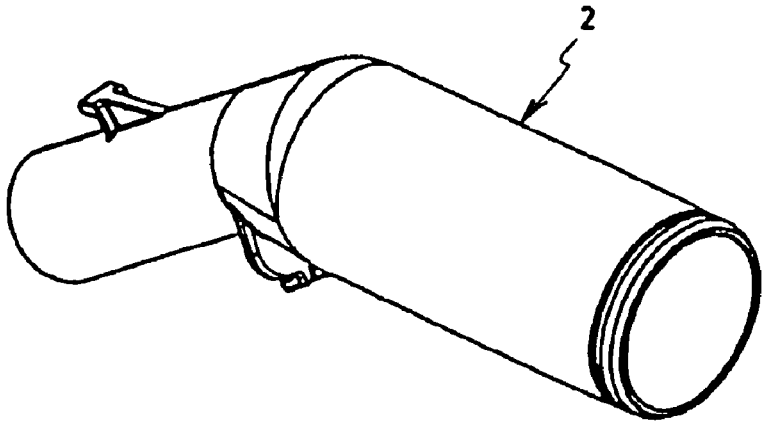
FIGS. 3*a* and 3*b* illustrate the outlet tube of the pouring spout, shown in the preceding figures, in perspective position and in cross-section.
Figure 3B:
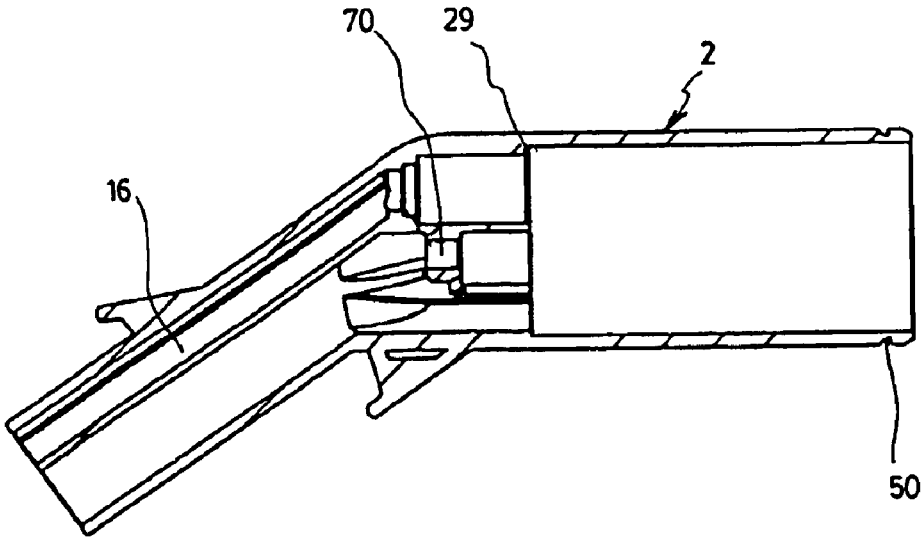
Figure 4A:
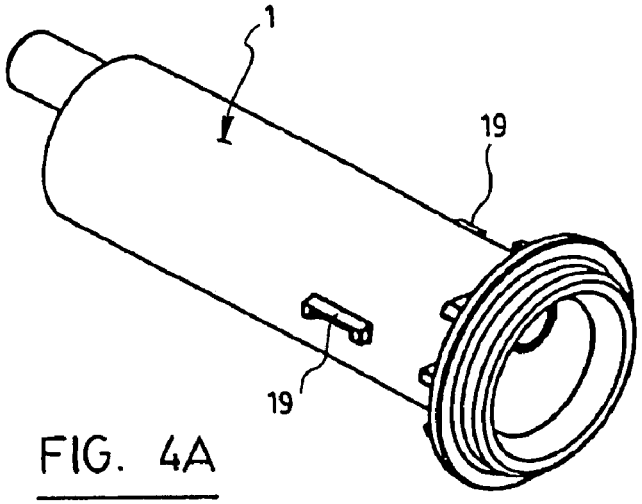
FIGS. 4*a* to 4*c* illustrate the inlet tube of the pouring spout shown in the preceding figures, in two different positions in cross-section.
Figure 4B:
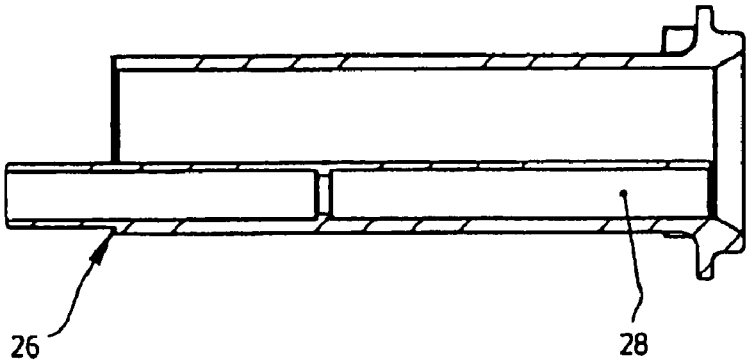
Figure 4C:
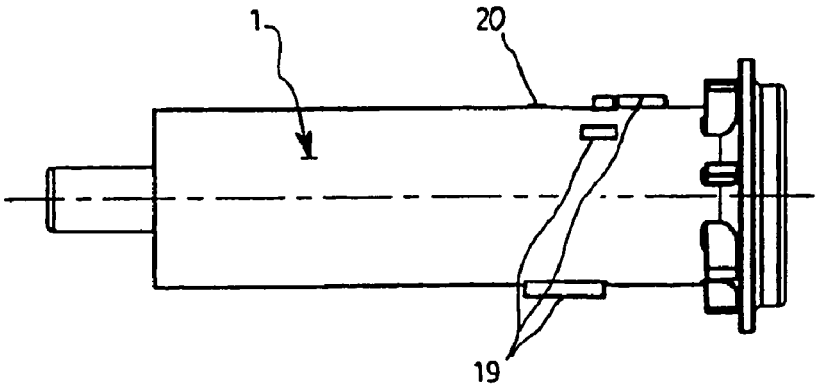

As is better illustrated in FIG. 1*c* of the drawings, another groove 50 is advantageously provided on the exterior surface of the end of the outlet tube 2 that is opposite to the outer exit portion 25, so as to hold a hook 51 that is part of the childproof security system 7. Such allows the childproof security system 7 to rotate on the inlet tube with an efficient close off function.

It is worth noting that the inlet tube 1 of the first illustrated embodiment also comprises an internal air duct 28 which is devised and positioned to be in line and communicate with the air duct 16 of the outlet exit portion 25 of the outlet tube 2.

In the first and second preferred embodiments of the invention, the spring 8, 18 is located in or on the air duct of the outlet tube. Such reduces its dimension and cost while making the assembly of the pouring spout easier. Such also increases the available space, thereby resulting in an increased liquid flow.

At the end of the portion of the inlet tube 1, 10 that is inserted into the outlet tube, a thin and flexible circular plastic ring 26 is positioned. This ring is devised to be pressed against a stopper 29 made into the inlet tube 2, 11, and thus act as a sealing means, to make the inlet and outlet tubes leakproof and thus provide the pouring spout with an automatic stop flow. In fact, when the liquid reaches the end of the spout, the flow decreases and, in most of the cases, is automatically stopped. Then, the container to which the pouring spout is connected, becomes itself under negative pressure since no air can penetrate into it when the liquid reaches the end of the spout 2, 11, unless there is an open ventilation hole in the container.

The pouring spout according to the third preferred embodiment of the invention is also a leak-proof unless there is an open ventilation hole in the container.

According to an essential characteristic of the invention, each of the three pouring spouts briefly disclosed hereinabove, comprises a valve system acting as both a liquid valve and an air valve to provide the pouring spout with a controlled and increasing flow. The valve system forms an opening mechanism which is controlled by the movement of the inlet and outlet tubes. This opening mechanism is devised to cause the liquid to flow more rapidly than the air may enter so that the outflow of liquid can create a negative pressure inside the container. This prevents the liquid from going into the air duct and thus from considerably reducing the liquid flow and/or considerably lengthening the start of the flow.

The entrance to the air valve is placed in order to direct the incoming air inside the container to which the pouring spout is connected, in such a manner as to prevent its interaction with the rapidly outflowing liquid. The purpose of the valve system which is actually a combined air and liquid valve, is actually to prevent the air and the liquid from conflicting with each other, and thus from reducing the liquid flow.

Of course, the valve system also controls the quantity of air entering the container to which the pouring spout is connected, and thus allows a rapid and constant flow without the air having to come in through the liquid outlet and to create a jerky or irregular flow.

Finally, opening of the valve system creates an opening movement which extends the air duct inside the container and reduces the difference of gravity between the liquid going out and the air coming in, thus increasing the liquid flow.

Figure 5A:
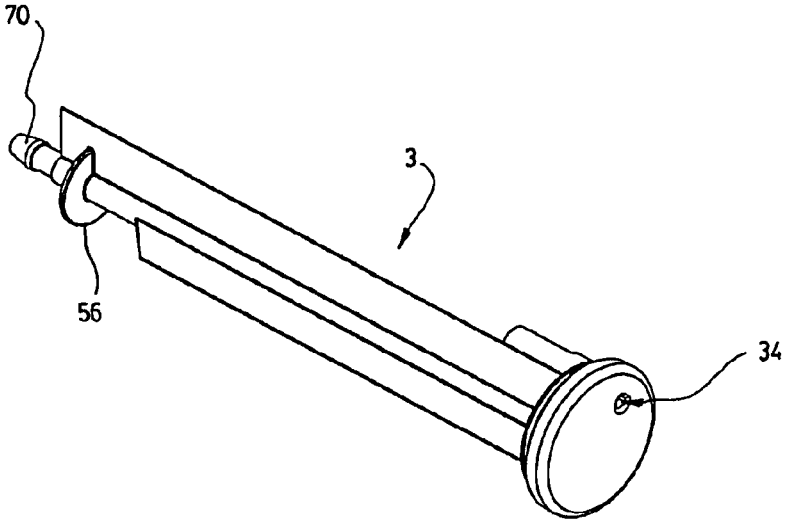
FIGS. 5*a* and 5*b* illustrate the valve of the pouring spout shown in the preceding Figures, in perspective and side position.
Figure 5B:
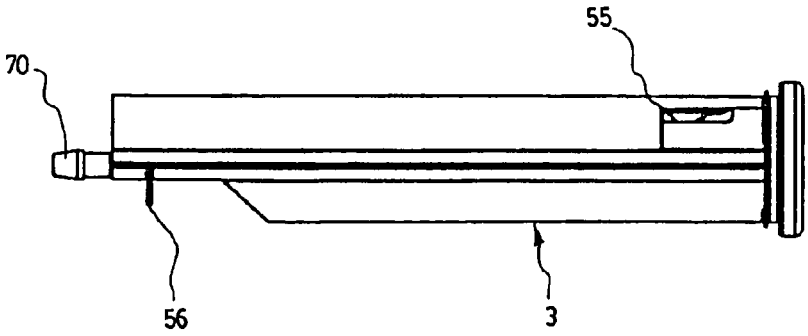
Figure 6:
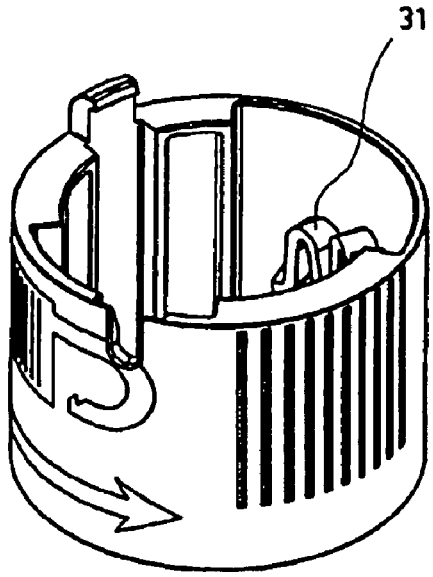
FIG. 6 illustrates the childproof security system of the pouring spout shown in the preceding Figures, in perspective position.
Figure 7:
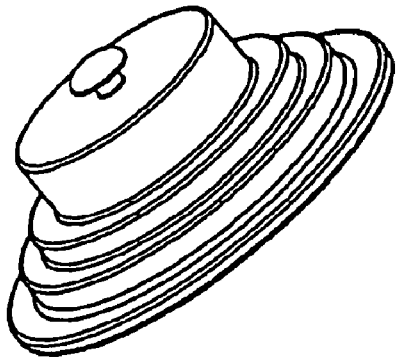
FIG. 7 illustrates the closing end and dirt protector of the pouring spout shown in the preceding Figures, in perspective position.

As is better shown in FIG. 5, in the first preferred embodiment identified as Model LV-06, the combined liquid and air valve is made of a single piece numbered 3, which is of an elongated form but divided into numerous longitudinal sections by radial walls that are of uneven height. The sections formed by these walls actually complete the air duct of the outlet tube 2 while also forming with it a liquid duct. Advantageously, the piece 3 comprises one or several transversal walls 56 that are positioned in a counterclockwise manner so as to regulate and control the liquid flow within a portion of the liquid duct formed within the inlet tube 1.

The end 55 of the piece 3 is shaped and positioned so as to form a closing wall. The portion of this end 55 that is in line with the air duct formed within the inlet tube 1, is of an angular, hollow shape and is ended with a narrow rectangular opening of a specific width and length selected so as to fit into the internal air duct 28 of the inlet tube 1. This end 55 permits in use to achieve gradual opening of the air duct while opening the valve 3. As aforesaid, the internal air duct 28 is devised and positioned to be in communication with the internal air duct 16 of the outlet tube 2 of the pouring spout.

In this first embodiment, it is worth noting that the final assemblage of the inlet and outlet tubes 1 and 2 is achieved thanks to a locking pin 70 that projects from the front end of the piece 3 and is designed to be introduced and held in a retaining ring 70 held in the middle of the outlet tube 2 by means of several plastic support braces.

Figure 8A:
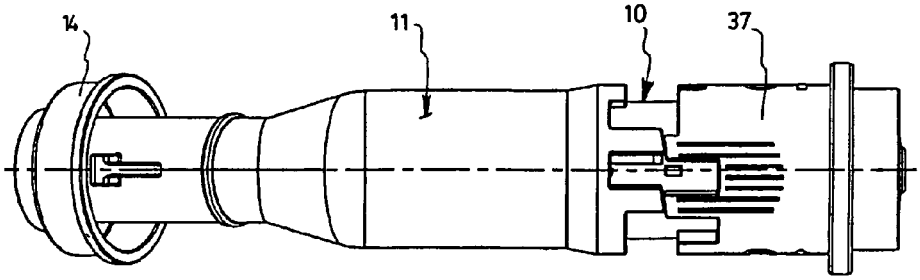
FIGS. 8*a*, 8*b*, and 8*c* illustrate a pouring spout in according to a second preferred embodiment of the invention hereinafter also called Model SCER-07, wherein said pouring spout is shown in closed position.
Figure 8B:
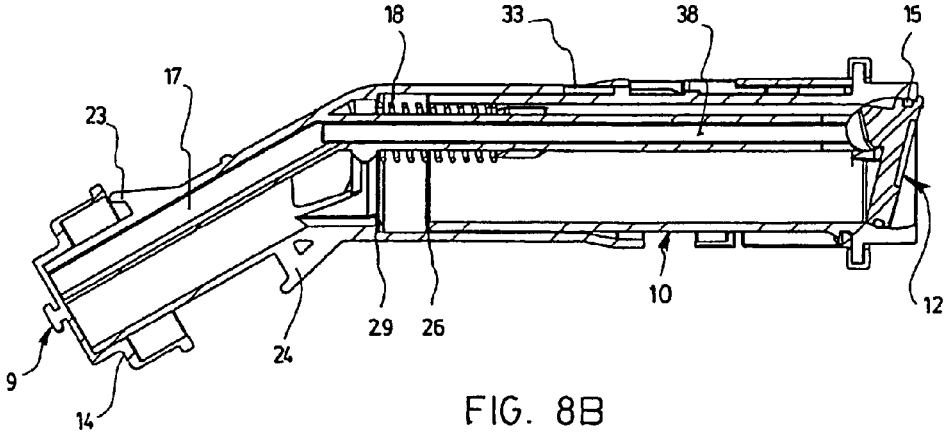
Figure 8C:
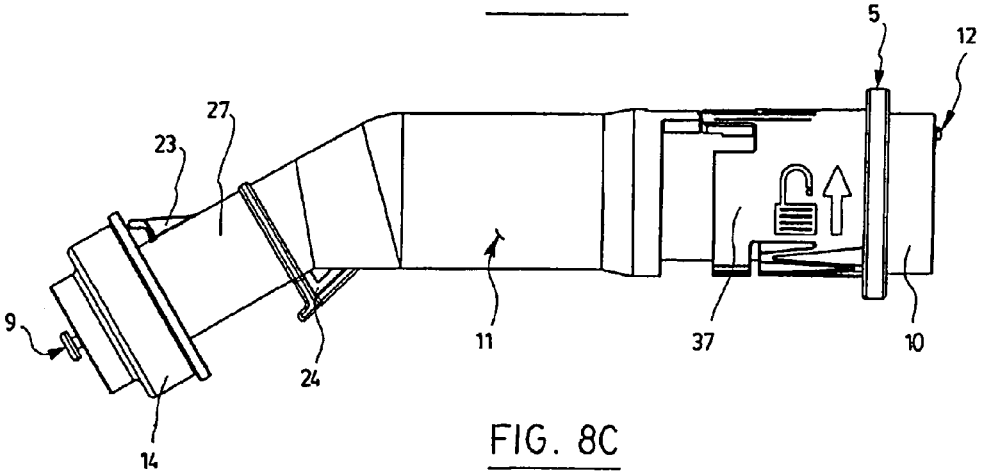
Figure 9A:
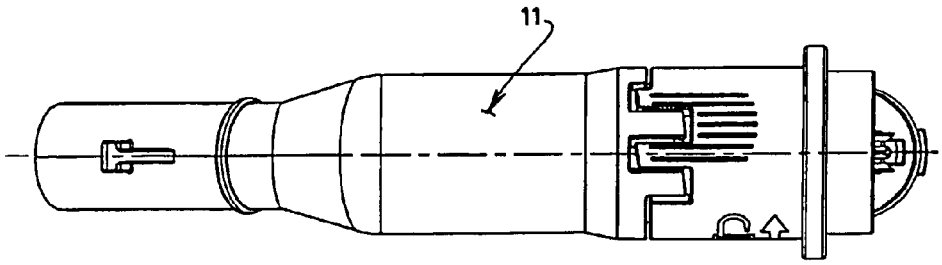
FIGS. 9*a*, 9*b*, and 9*c* are views similar to those of FIGS. 8*a*, 8*b*, and 8*c*, except that the pouring spout is shown in open position.
Figure 9B:
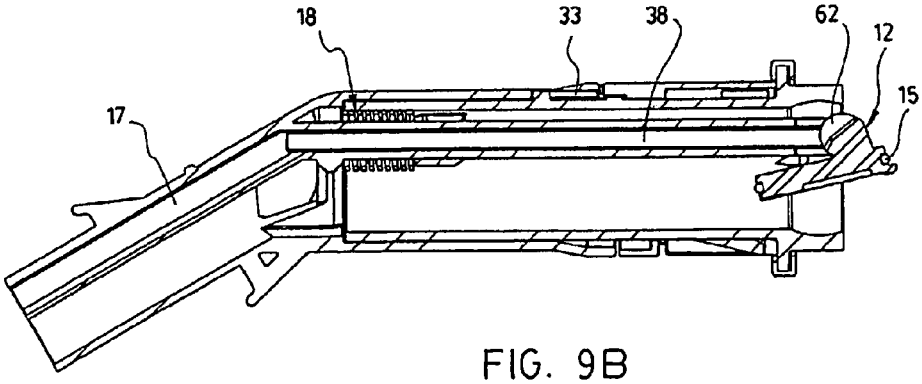
Figure 9C:
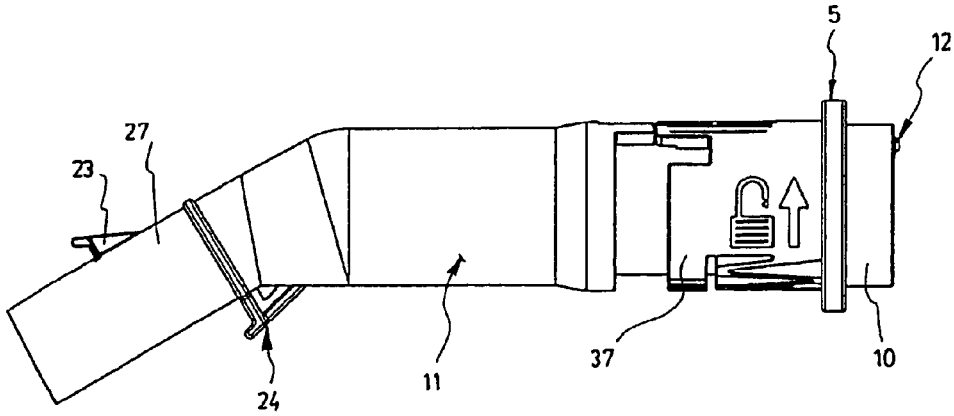
Figure 10A:
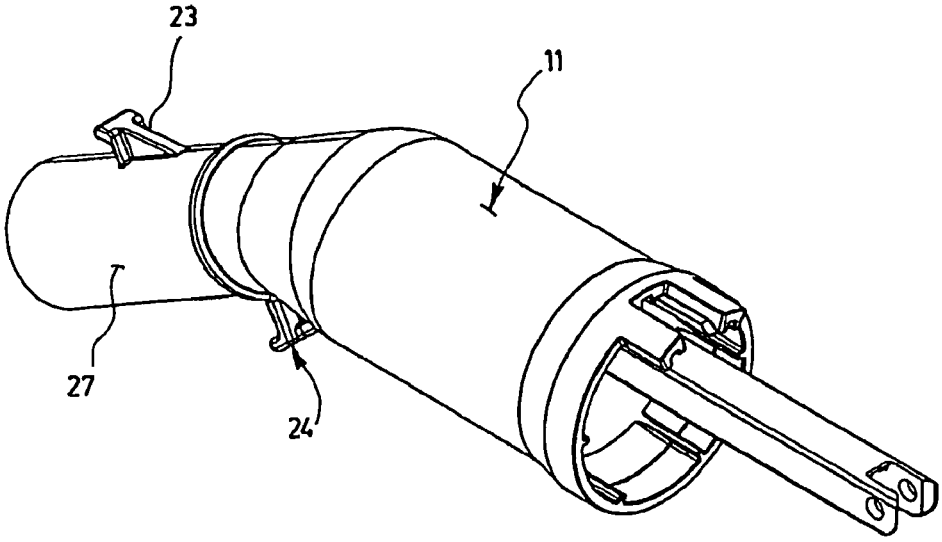
FIGS. 10*a* and 10*b* illustrate the outlet tube of the pouring spout shown in FIGS. 8*a* to 9*c*, in perspective position and in cross-section.
Figure 10B:
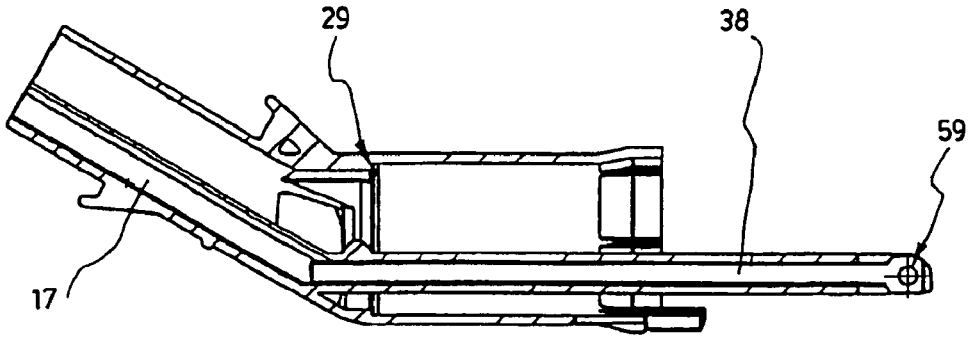
Figure 12:
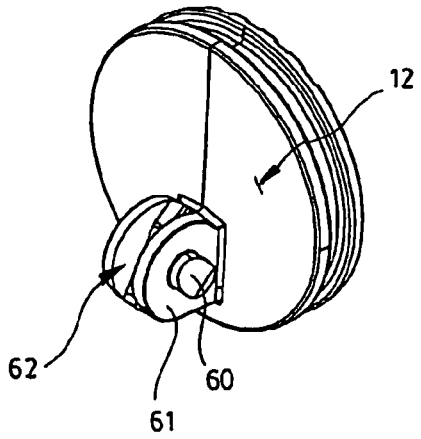
FIG. 12 illustrates the bascule valve of the pouring spout shown in FIGS. 8*a* to 9*c*, in perspective position.
Figure 14:
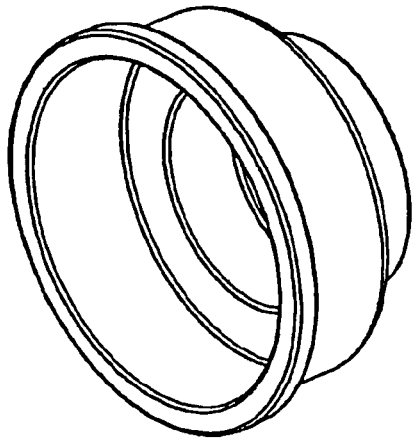
FIG. 14, illustrates the closing end and dirt protector of the pouring spout shown in FIGS. 8*a* to 9*c*, in perspective position.
Figure 13:
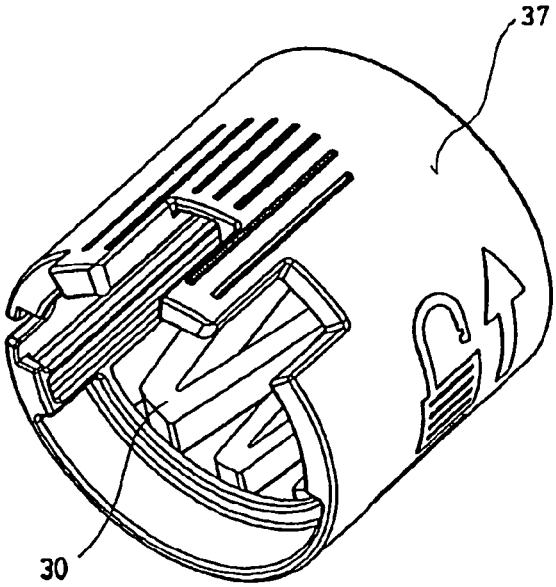
FIG. 13 illustrates the childproof security system of the pouring spout according to the second preferred embodiment of the invention shown in FIGS. 8*a* to 9*c*, in perspective position.

In the second preferred embodiment of the invention identified as Model SCER-07, the valve system which is better shown in FIGS. 9*a*, 9*b* and 12, consists of a bascule valve 12 pivotably mounted at an extremity 59 of a tube 38 which forms an integral part of the outlet exit portion 27 of the outlet tube 11 and is positioned so as to act as a prolongation of the air duct 17 of the outlet exit portion 27 of the outlet tube 11 (see FIG. 10), and as a support and a guide for the spring 18 (see FIG. 8*b*).

Figure 11A:
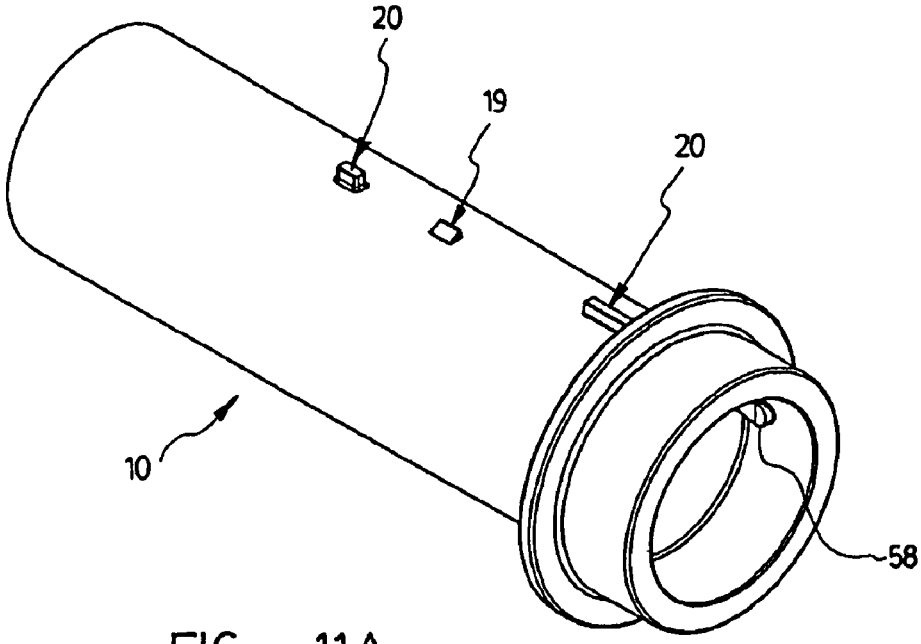
FIGS. 11*a* and 11*b* illustrate the inlet tube of the pouring spout shown in FIGS. 8*a* to 9*c*, in perspective position and in cross-section.
Figure 11B:
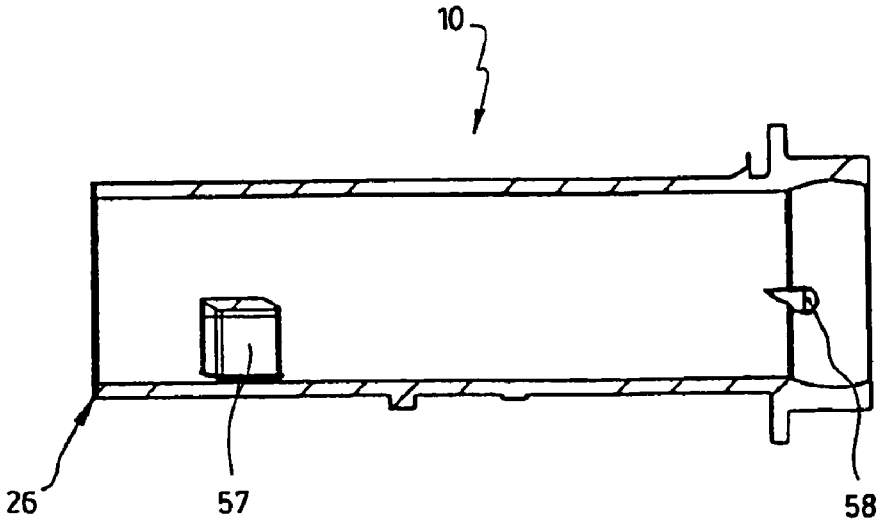

As shown in FIG. 12, a stopper 62 is provided onto the bascule valve 12 to stop it at proper angle and thus allow the pouring spout to be always correctly closed in the same position. As shown in FIG. 11, stoppers 58 are also provided inside the inlet tube 10 to guide the bascule valve to reach its close off position without restriction.

As is shown in FIG. 11, a holding ring 57 is provided inside the inlet tube 10 to receive the tube 38 and retain the spring 18 which is mounted on it.

As aforesaid, the bascule valve 12 is pivotably connected to the extremity 59 of the tube 38. To do so, this extremity 59 is provided with opposite holes in which may be inserted pins 60 projecting from a support 61 forming part of the valve 12. The pins 60 advantageously have ends extending at an angle so as to facilitate their insertion into the holes at the extremity 59 of the tube 38. Such substantially facilitate the assembly of the outlet tube 11, inlet tube 10 and bascule valve 12.

As is better shown in FIG. 12*b*, the support 61 is provided with a U-shaped recess 62 positioned so as to be in line with the holding tube and thus to allow and control air entrance within the container when the pouring spout is activated.

As is also shown in FIGS. 8*b* and 9*b*, the bascule valve 12 is provided with a peripheral seal 18 that comes into contact with the inner tube and thus makes it spill-proof.

In the third preferred embodiment of the invention identified as Model BV-08, the valve system comprises a valve head 108 that is integral to the inlet portion of the outlet tube 93 and externally projects from the same so as to come into contact with the front edge of the outlet tube when the pouring spout is closed. This valve head 108 is itself closed by an end wall 99 that may be integral to or welded to it.

Figure 15A:
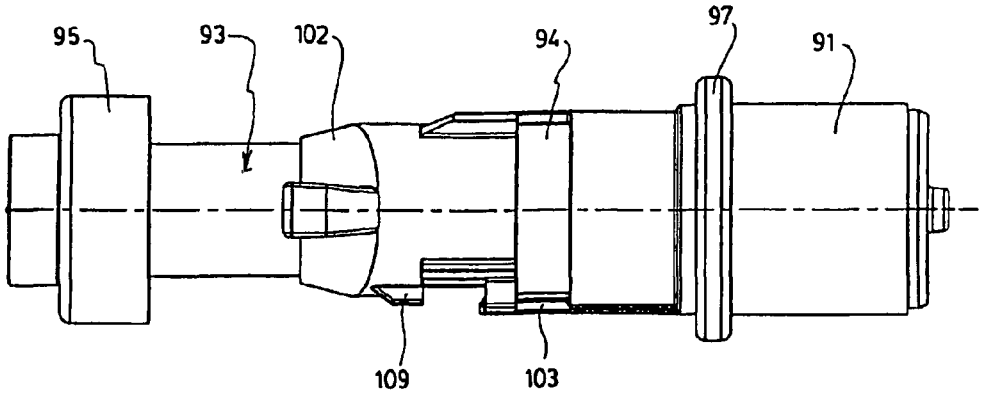
FIGS. 15*a*, 15*b*, and 15*c* illustrate a pouring spout according to a third preferred embodiment of the invention, hereinafter also called Model BV-08, wherein said pouring spout is shown in closed position.
Figure 15B:
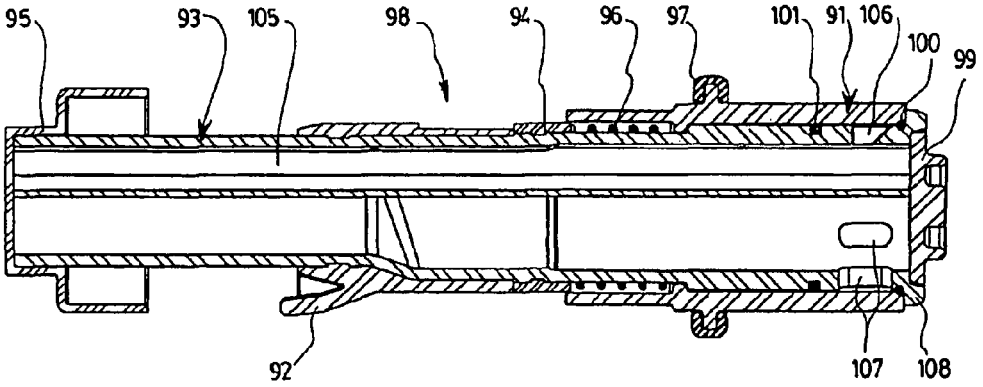
Figure 15C:
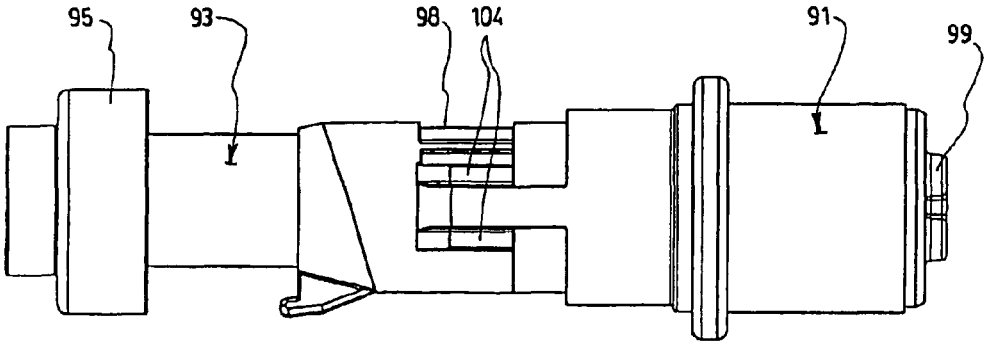
Figure 16A:
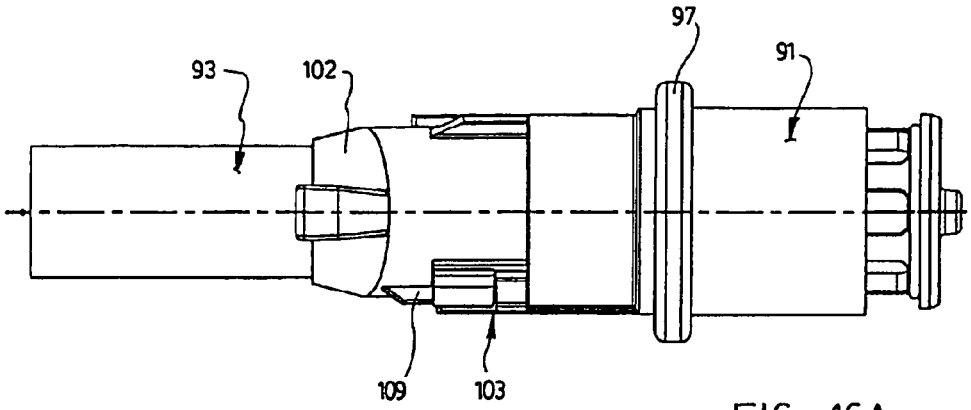
FIGS. 16*a*, 16*b*, and 16*c* are views similar to those of FIGS. 15*a*, 15*b*, and 15*c* except that the pouring spout is shown in open position.
Figure 16B:
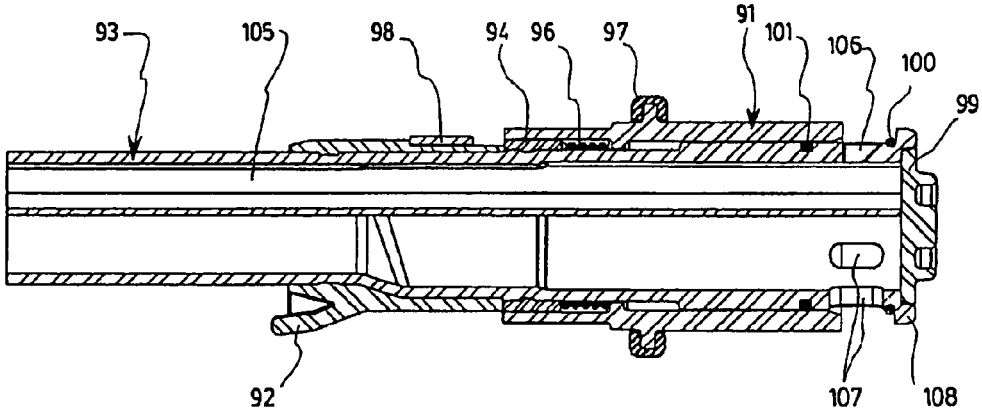
Figure 16C:
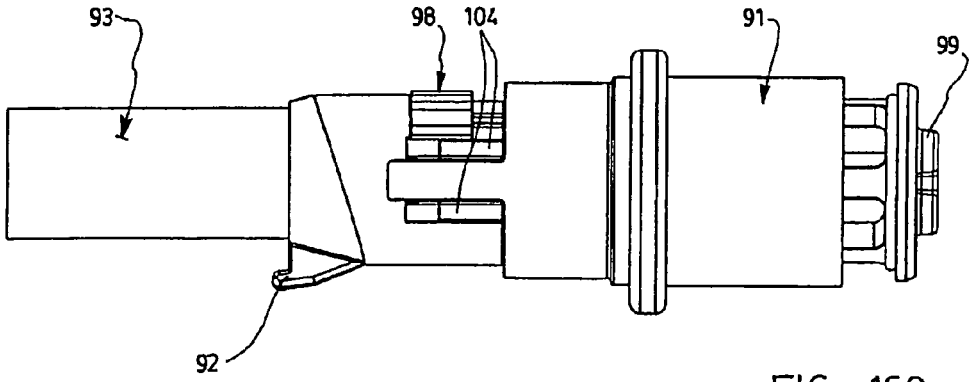
Figure 17A:
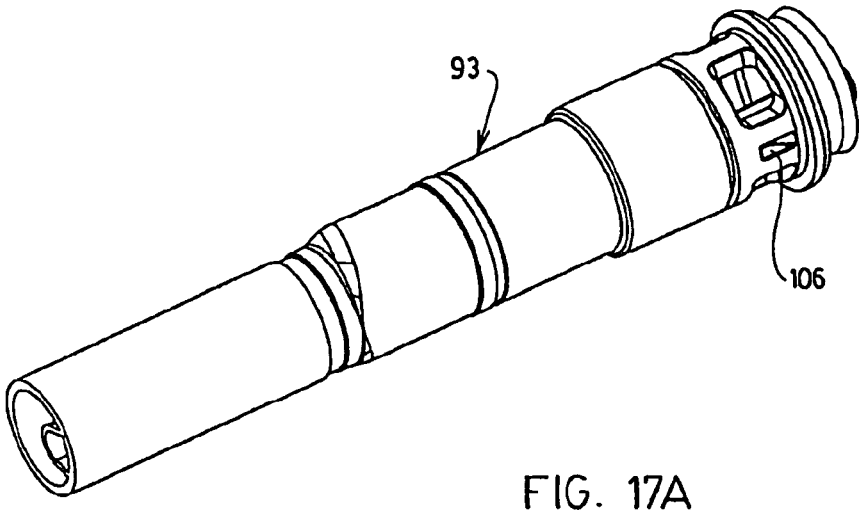
FIGS. 17*a* and 17*b* illustrate the outlet tube of the pouring spout shown in FIGS. 15*a* to 16*c* which includes a cap at its end, in perspective position and in cross-section.
Figure 17B:
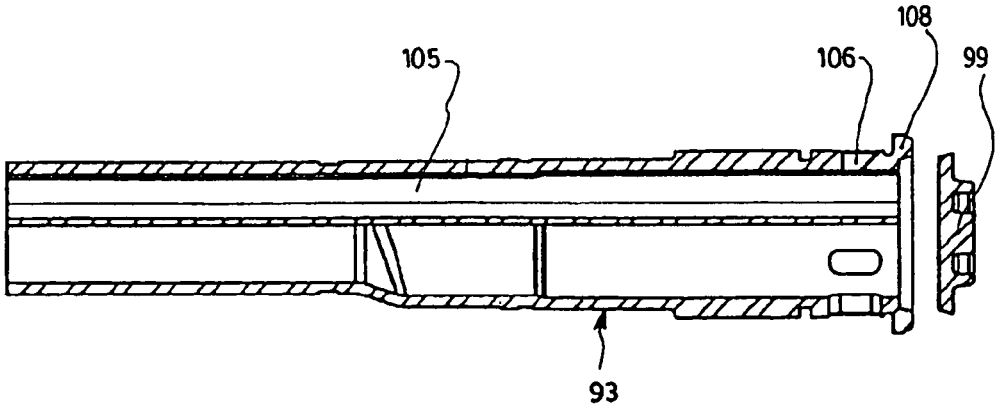
Figure 18:
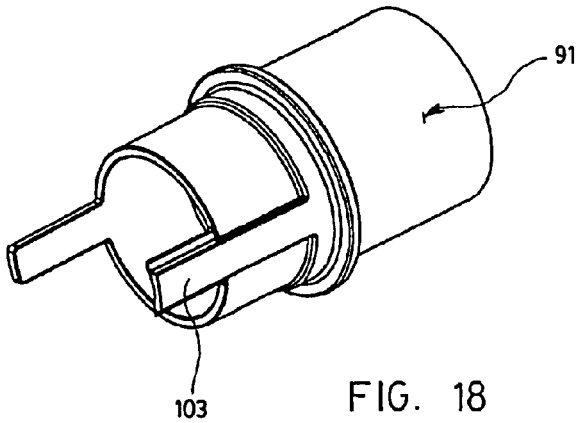
FIG. 18 illustrates the inlet tube of the pouring spout shown in FIGS. 15*a* to 16*c*, in perspective position.
Figure 19:
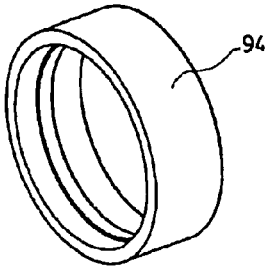
FIG. 19 illustrates the circular spring retaining ring of the pouring spout shown in FIGS. 15*a* to 16*c*, in perspective position.
Figure 20:
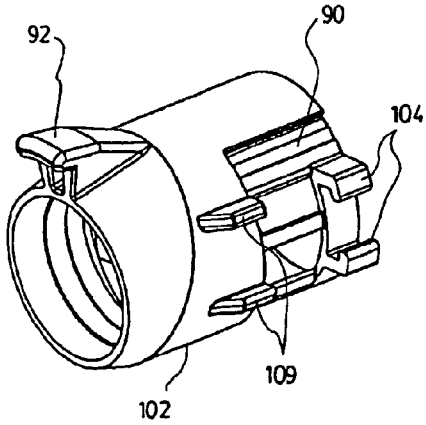
FIG. 20 illustrates the assembling ring of the pouring spout shown in FIGS. 15*a* to 16*c* in perspective position.
Figure 21:
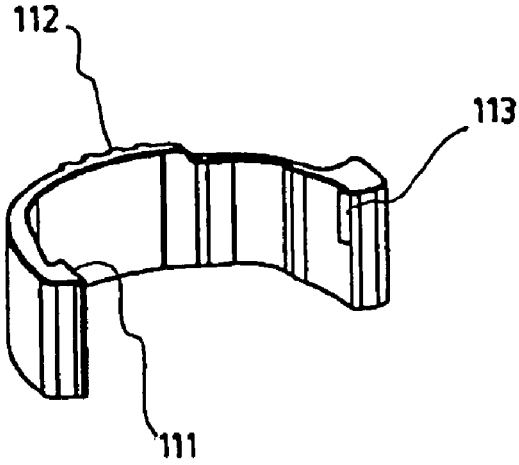
FIG. 21 illustrates the childproof security system of the pouring spout shown in FIGS. 15*a* to 16*c*, in perspective position.
Figure 22:
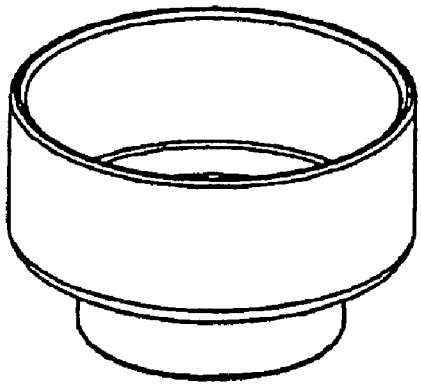
FIG. 22 illustrates the dust cap of the pouring spout shown in FIGS. 15*a* to 16*c*, in perspective position.
Figure 23A:
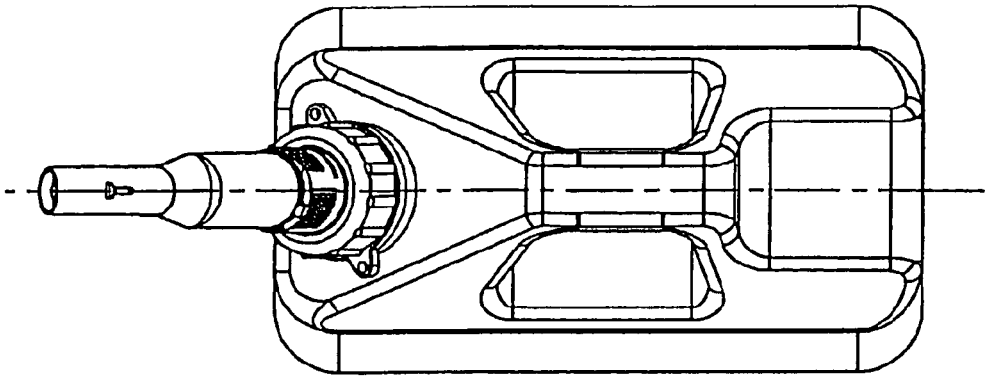
FIGS. 23*a* to 23*d* illustrate the pouring spout according to the first preferred embodiment of the invention shown in FIGS. 1*a* to 2*c* when the said pouring spout is installed on a container for usage purposes, or for the purpose of closing and storing the container, in top plan views and cross-section.
Figure 23C:
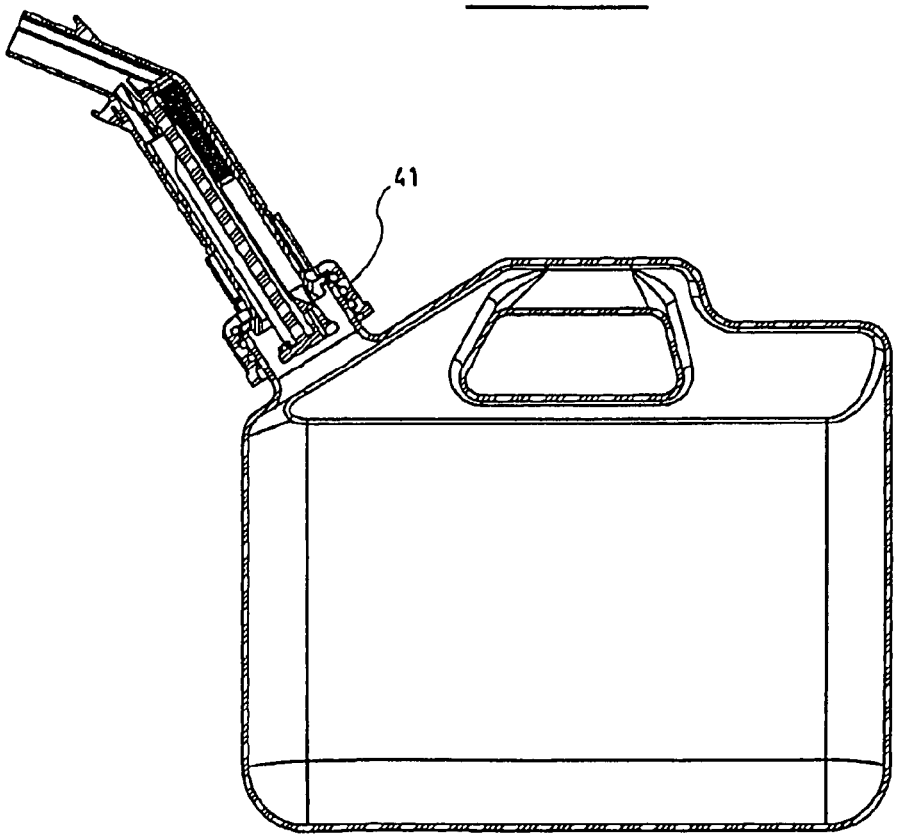
Figure 23B:
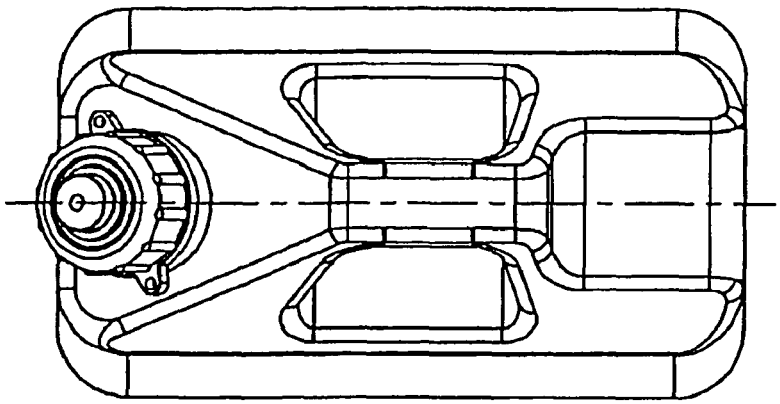
Figure 23D:
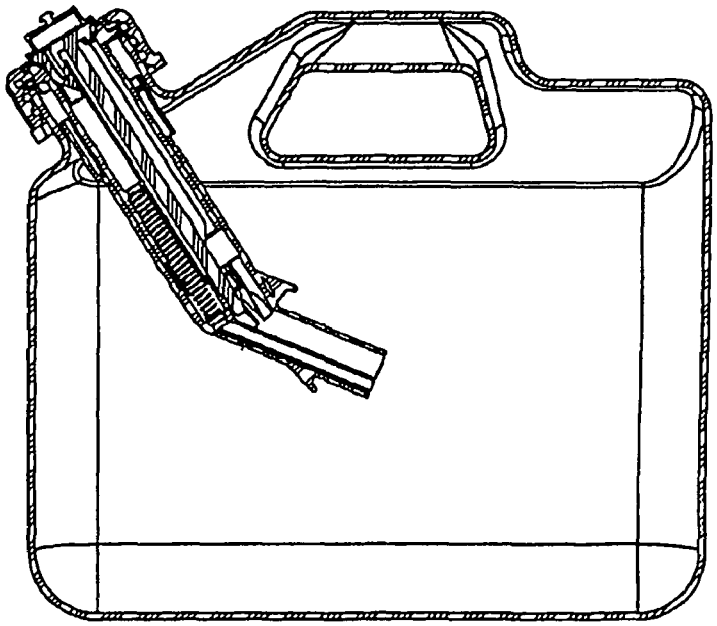
Figure 24A:
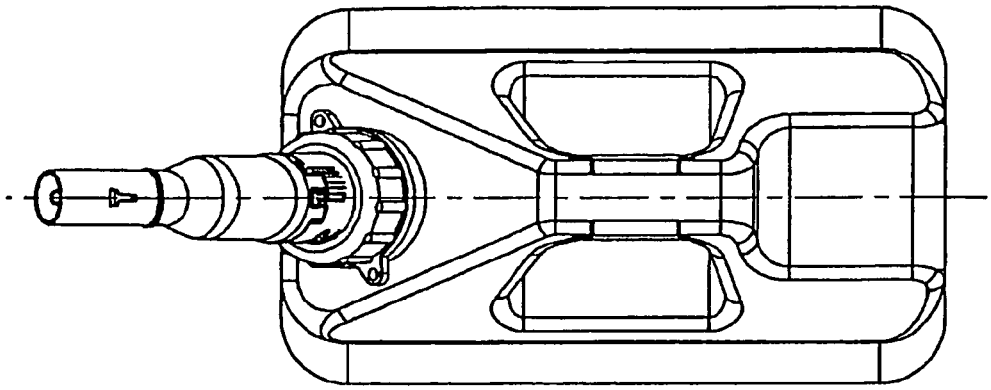
FIGS. 24*a* to 24*d* illustrate the pouring spout according to the second preferred embodiment of the invention, shown in FIGS. 8*a* to 9*c* when the said pouring spout is installed on a container for usage purpose or for the purpose of closing or storing said containers, in top plan views and cross-section.
Figure 24C:
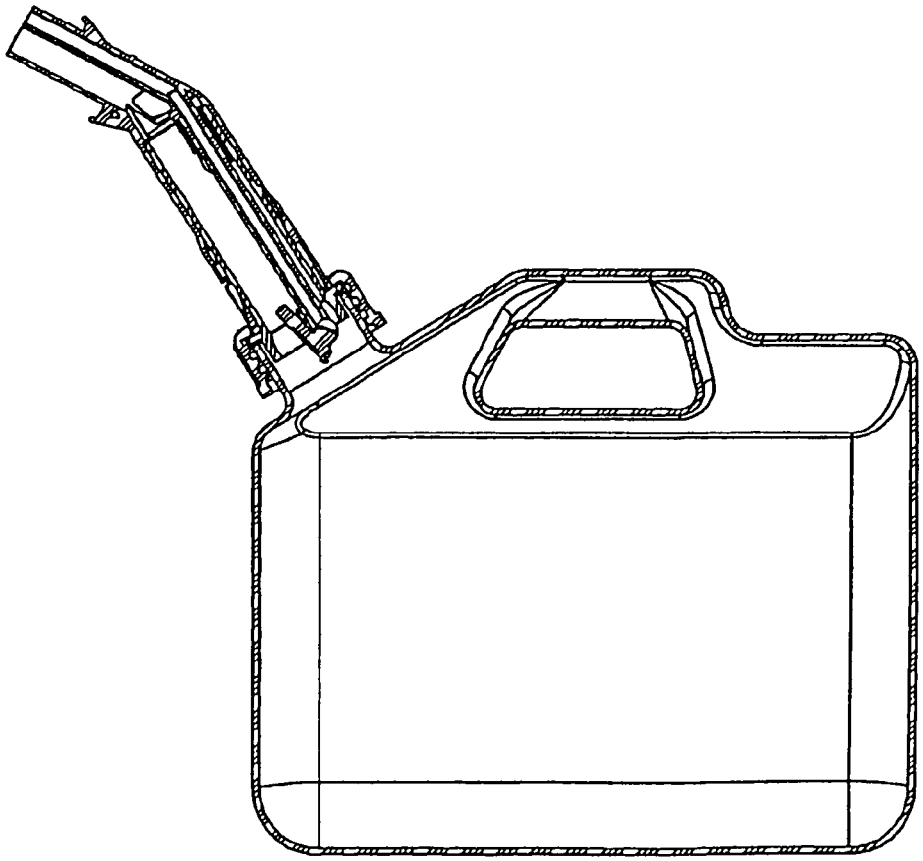
Figure 24B:
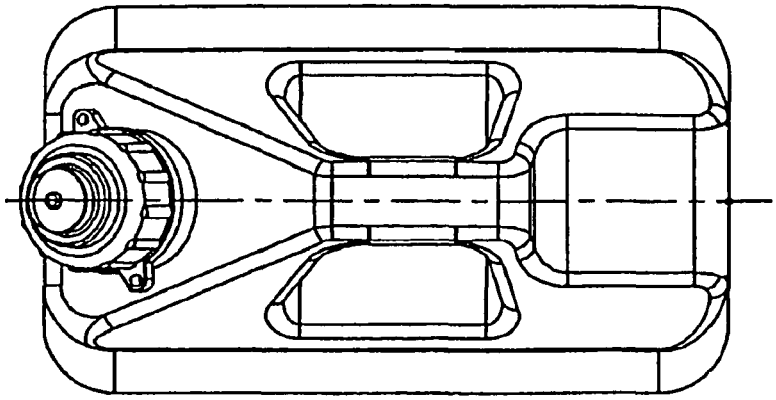
Figure 24D:
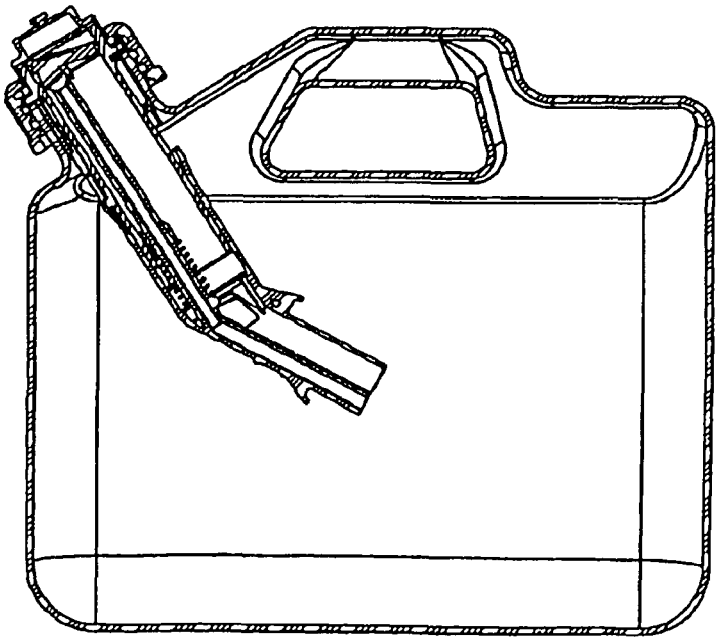
Figure 25A:
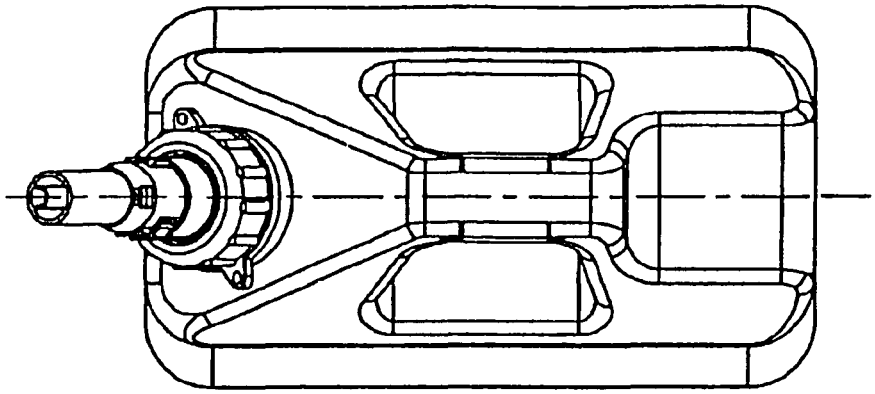
FIGS. 25*a* to 25*d* illustrate the pouring spout according to the third preferred embodiment of the invention, shown in FIGS. 15*a* to 16*c* when the said pouring spout is installed on a container for usage purpose, or for the purpose of closing or storing this container, in top plan views and cross-section.
Figure 25C:
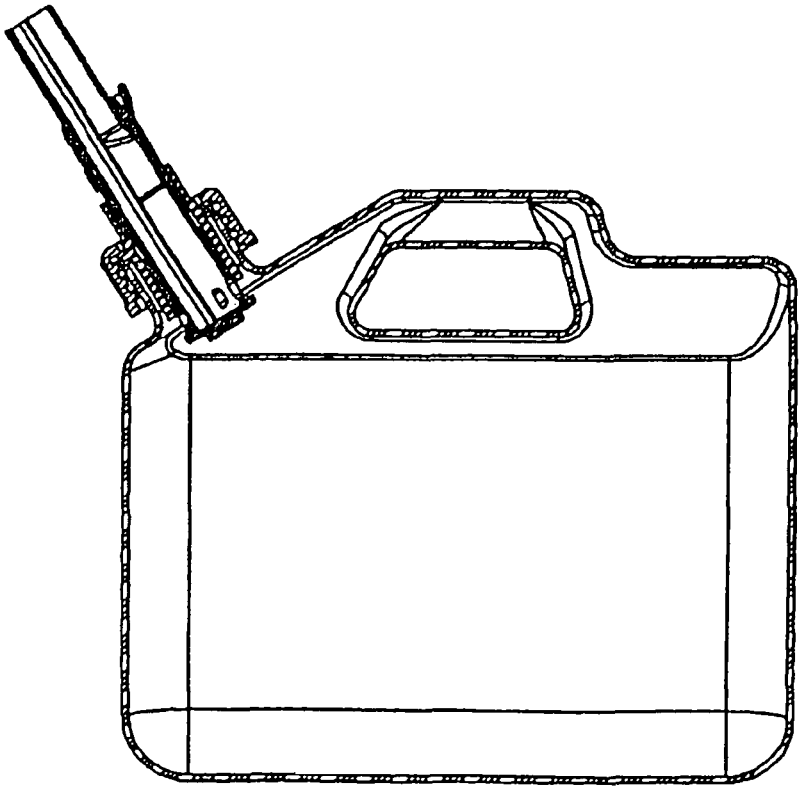
Figure 25B:
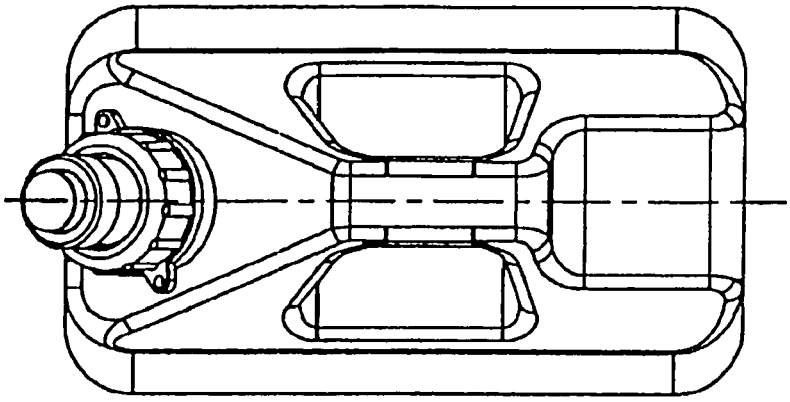
Figure 25D:
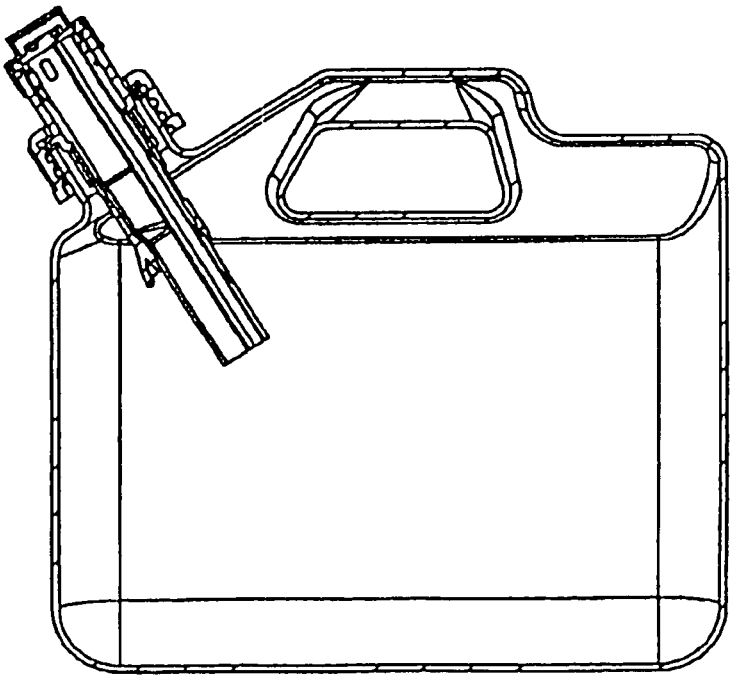

The valve system also comprises a hole 106 made into the outlet tube 93 close to the valve head 108, so as to give access to the air duct 105 made in the outlet tube. Other holes 107 are also provided in the outlet tube 93 close to the valve head 108, so as to give access to the liquid duct made in the outlet tube 93. Opening of the holes 106 and 107 is achieved when the outlet tube 93 is pushed back within the inlet tube 91 (see FIGS. 15*b* and 16*b*).

As can be noticed, the three pouring spouts disclosed hereinabove, have valve systems at their inside ends that are different from each other, but serve in all cases to open and close the liquid duct and air duct at the same time and to hold the assembled parts of the pouring spout together. Such considerably reduces the fabrication and assembling costs. The closed positions of these valve systems are illustrated in FIGS. 1*a* to 1*c*, 8*a* to 8*c* and 15*a* to 15*c*. The open positions of the same valve systems are also illustrated in FIGS. 2*a* to 2*c*, 9*a* to 9*c* and 16*a* to 16*c*, respectively.

As can also be noticed, the three pouring spouts disclosed hereinabove, are designed in such a way as to allow liquid to flow and create a vacuum inside the container before the air duct is completely filled with liquid, thus allowing a rapid flow start and preventing a jerky or irregular liquid outflow.

Each of the three pouring spouts disclosed hereinabove, also has its valve system directly linked to the inlet tube 2, 11, 93E, so as to be activated by the user when he or she decides to use the pouring spout. It is worth noting also that in all cases, opening of the valve system is gradual. When the liquid valve is partially opened, the air entrance which is mechanically linked to it, opens gradually to a maximum already adjusted and is extended inside the container in order to reduce the differential between the air entrance and liquid outflow. Such greatly increases the liquid flow.

In the first and second preferred embodiments disclosed hereinabove, a childproof security system for use as a child protection 7, 37 is also provided. This system 7, 37 is in the form of a ring mounted to pivot around the outlet tube at the rear end of the same. It is held and activated by a spring 30, 31 and by means of stoppers or supports 19, 20, 53 of different shapes.

In the third preferred embodiment disclosed hereinabove, a child security system 98 is also provided. This system is in the form of a C-shaped flexible part 98 which is snapped onto a recess 110, and can be unlocked on a notch 90, provided on an assembling ring 102. Of course, other security systems could be used if need be, especially when the pouring spout is devised for an industrial model.

In the locked position, the flexible part 98 is positioned between fixed guides 109 forming part of the ring 102 and the stoppers 103 projecting from the inlet tube 9. By applied pressure on a push point 112, a lock 113 is removed and allows the stopper to pass over the flexible part 98. Such allows disengagement and thus partial or full opening of the pouring spout by removing the pressure on the notch 92. Of course, the spring which is then loaded, will close and lock the spout again as soon as no more pressure is applied to it.

As aforesaid, in the first and second preferred embodiments of the invention identified as models LV-06 and SCER-07, the childproof security systems comprise springs 30, 31 that are held compressed in order to ensure an automatic shut off of the security system after complete or partial use, and thus lock the security childproof system to prevent accidental opening, or opening by a child.

With these models LV-06 and SCER-07, the childproof security system must be turned in order to open the pouring spout, in the direction shown on it with an arrow, until it reaches the stopper that holds it into an open position. Then, the pouring spout may be opened. While opening, the childproof security system slides against the adjacent stopper until it is no longer in contact with the stopper. This allows the system to return to its childproof security closing position when closing the pouring spout.

When the pouring spout is open, the childproof security system is of course held in an unlocked position. Thus, the pouring spout can be opened completely. After complete or partial opening of the pouring spout while filling a gas motor tank, or when the user releases the pressure on the supports of the pouring spout, the flow stops and the childproof security system is automatically closed and locked.

Caps 6, 14, 95 can be used to stop dust and dirt from falling inside the pouring spout, thereby ensuring a clean filling and better efficiency. These caps are devised to fit onto at least the outlet exit portion of the outlet tube and optionally onto the inlet tube in order to prevent undue entry of dust or dirt. These caps can also be used to close the container during the sale process and/or for security while transporting. In use, these caps prevent dust and dirt from going into the pouring spout. They are also useful to close the container when the pouring spout is inside said container as is shown in FIGS. 23*b* and 23*d*, 24*b* and 24*d* and 25*b* and 25*d*. As is shown, each of said caps may also comprise attachment means 9 for use to connect it to some other part of the pouring spout such as the childproof security system and thus to prevent it from being lost.

FIGS. 23*a* to 23*d*, 24*a* to 24*d* and 25*a* to 25*d* illustrate the three pouring spouts described hereinabove, installed in, on, or in a container. It is worth noting that the pouring spouts may be installed outside of the container for filling purposes, or installed in a reverse position, inside the container for storage.

Their connection to a container can be made in various ways such as with the help of a cap 41, a fixed threaded base or any other type of adaptable base with or without threading in order to answer all the needs. In every case, the pouring spout according to the invention ensures liquid proofness thanks to its valve system.

As aforesaid, the key feature of the present invention is the presence of a valve system that opens and closes the liquid outlet and the air entrance independently from each other. This system is positioned at the entrance of the pouring spouts, and is activated by the movement of the inlet tube 2, 11 and 93E. When activated, the valve system allows:

(i) to separately open the liquid duct and, when activated, the air duct leading to the container;

(ii) to close the liquid duct and the air duct at the same time;

(iii) to obtain a rapid flow even when the pouring spout has a smaller outlet, such making the pouring spout usable to fill-up a car and/or a small container;

(iv) to obtain a reduction of the surfaces exposed to evaporation and permeability and thus a reduction to a minimum of the contact with adjacent products, such meeting the strictest environmental norms; and (v) to direct the air flow in a direction opposite to the liquid entrance, such facilitating the air entrance into the container while preventing a mixture between the air and liquid which would affect the speed of the liquid flow.

It is also worth noting that in some cases, the air valve portion of the valve system does not open until the liquid valve portion of the same system is open 20 to 30%, thereby allowing a negative pressure to be built up inside the container. Such a negative pressure is actually needed to achieve efficient functioning of the auto-vented automatic stop flow pouring spout on a container without vent. The delayed opening of the air duct prevents the liquid from entering the air duct and accelerates the start of liquid flow while preventing it from being slow and jerky. Such also ensures a controlled and increasing flow depending on the opening of the liquid valve portion for a faster start and a more regular flow. While opening the pouring spout, the air duct that extends inside the container, considerably increases the flow.

The fact that the spring are near or inside the air ducts is also an interesting feature of the invention inasmuch as it reduces the cost of the springs and increases the space available for the liquid flow.

In the first and second preferred embodiments identified as models LV-06 and SCER-07, the assembly is easy and simplified. Such allows the time and cost of the assembly to be reduced. Moreover, in these two embodiments, the fact that the outlet exit portion 25, 27 extends at an angle, allows visual control inside the container or tank being filled.

In the third preferred embodiment identified as model BV-08, the assembly between the inlet tube and the outlet tube of the pouring spout is made by expanded parts that lock into grooves and hold the ring that retains the spring. This also simplifies the assembly and thus allows the cost and time of assembly to be reduced.

Thanks to the teeth 21, 22, 23, 24, 92 that permit to hang the filling container onto the container or tank to be filled up, the pouring spout according to the invention permits, just after having deactivated the childproof security 7, 37, 98, to open the valve system without the help of a hand. The teeth also hold most of the container's weight when in use.

As aforesaid, the pouring spout according to the invention is childproof and secure due to its mechanism which disengages manually and engages automatically after a partial or complete opening of the pouring spout.

As is disclosed hereinabove, an important feature of the invention lies in that the liquid duct, air duct and valve system are integrated to the outlet tube slideably connected to the inlet tube that is devised to be connected to the container. The outlet tube is of course provided with an outlet exit portion through which air may enter into the air duct and the liquid may exit through the liquid duct. The inlet and outlet tubes are kept by an internal spring in such a position with respect to each other as to keep the valve system closed unless a pressure is applied to the outlet tube.

As is also disclosed hereinabove, the pouring spout according to the invention is advantageously equipped with a stopper on the inlet tube and a small circular plastic ring 26 which renders the pouring spout spill-proof when it is fully open. The tightness between the stopper and the ring creates a seal between the inner and outer tubes, thereby preventing air to be introduced between the two tubes, such causing the liquid flow to decrease and in most cases stop.

Of course, numerous minor modifications could be made to the three preferred embodiments disclosed hereinabove without departing from the scope of the invention as claimed hereinafter.

The invention claimed is:

1. A pouring spout for a liquid-storage container, the pouring spout comprising:

an inlet tube detachably connectable to the liquid-storage container;

an outlet tube slideably connected to the inlet tube for guiding a liquid from the inlet tube to a receiving container or tank;

a liquid duct that is part of both the inlet tube and the outlet tube and through which the liquid can flow out of the liquid-storage container;

an air duct that is part of both the inlet tube and the outlet tube and through which air can enter the liquid-storage container;

a valve system for opening the liquid duct and the air duct when the outlet tube is slideably moved relative to the inlet tube, the valve system separately opening the liquid duct and the air duct into the liquid-storage container; and an internal spring keeping the valve system into a closed position unless the outlet tube is slideably moved relative to the inlet tube;

wherein the outlet tube is slideably mounted externally onto the inlet tube and the valve system consists of a single piece of elongated form that is slideably mounted internally within the inlet tube, said piece having one end that is rigidly connected to the outlet tube so as to be moved with the outlet tube relative to the inlet tube and that is divided into several longitudinal sections by means of radial walls so as to complete the liquid duct and the air duct of the outlet tube, said piece also having an opposite end shaped so as to act as a closing wall, said other end having a portion that is in line with the air duct and being of an angled hollow shape and provided with a narrow rectangular opening that permits a clear gradual opening of the air duct separately from the opening of the liquid duct when the piece is pushed by the outlet tube within the liquid-storage container in order to open the liquid-storage container.

2. The pouring spout according to claim 1, further comprising a child-proof security system that has to be deactivated in order to allow the outlet tube to slide relative to the inlet tube and thus to open the valve system.

3. The pouring spout according to claim 2, wherein the outlet tube comprises at least one external tooth that projects in such a manner as to allow in use said outlet tube to be pressed against a neck of the receiving container or tank and thus to cause the outlet tube to slide relative to the inlet tube and the valve system to open while also helping to support the weight of the liquid-storage container to which the pouring spout is connected.

4. The pouring spout according to claim 1, further comprising sealing means to make the outlet and inlet tubes leak-proof.

5. The pouring spout according to claim 1, further comprising a cap to be positioned on an outlet exit portion of the outlet tube and optionally onto the inlet tube in order to prevent dust or dirt from entering into the pouring spout.

6. The pouring spout according to claim 1, wherein the piece acting as said valve system also comprises one or more transversal walls that are positioned to regulate and control the liquid flow when the liquid passes through the pouring spout.

7. The pouring spout according to claim 6, further comprising:

a child-proof security system that has to be deactivated in order to allow the outlet tube to slide relative to the inlet tube and thus to open the valve system, wherein the outlet tube comprises at least one external tooth that projects in such a manner as to allow in use said outlet tube to be pressed against a neck of the receiving container or tank and thus to cause the outlet tube to slide relative to the inlet tube and the valve system to open while also helping to support the weight of the liquid-storage container to which the pouring spout is connected;

sealing means to make the outlet and inlet tubes leak-proof; and a cap fitting onto an outlet exit portion of the outlet tube and optionally onto the inlet tube in order to prevent dust or dirt from entering the pouring spout.

8. The pouring spout according to claim 1, wherein the valve system first partially opens the liquid duct and then opens the air duct.

9. A pouring spout for a liquid-storage container, the pouring spout comprising:

an inlet tube detachably connectable to the liquid-storage container;

an outlet tube slideably connected to the inlet tube for guiding a liquid from the inlet tube to a receiving container or tank;

a liquid duct that is part of both the inlet tube and the outlet tube and through which the liquid can flow out of the liquid-storage container;

an air duct that is part of both the inlet tube and the outlet tube and through which air can enter the liquid-storage container;

a valve system for opening the liquid duct and the air duct when the outlet tube is slideably moved relative to the inlet tube, the valve system separately opening the liquid duct and the air duct into the liquid-storage container; and an internal spring keeping the valve system into a closed position unless the outlet tube is slideably moved relative to the inlet tube;

wherein the outlet tube is slideably mounted externally onto the inlet tube and the valve system consists of a bascule valve pivotably mounted at an extremity of a holding tube that is part of the outlet tube and is devised so as to extend within the inlet tube and to act as part of said air duct and as a support and a guide for the internal spring of said pouring spout, said holding tube passing through a holding ring that is part of the inlet tube and devised so as to retain the internal spring, the bascule valve being mounted onto the holding tube by means of a support that is part of said bascule valve and is provided with a U-shaped recess which is positioned so as to be in line with the holding tube and thus to allow and control air entrance within the liquid-storage container when the pouring spout is activated, the bascule valve in closed position extending fully across the inlet tube and thus preventing both air and liquid from passing into the inlet tube, said inlet tube and said bascule valve comprising stoppers positioned so as to guide and stop the bascule valve in closed position.

10. The pouring spout according to claim 9, wherein the bascule valve is provided with a peripheral seal that comes into contact with the inner tube when the valve system is closed and thus makes the inner tube spill-proof.

11. The pouring spout according to claim 10, further comprising:

a child-proof security system that has to be deactivated in order to allow the outlet tube to slide relative to the inlet tube and thus to open the valve system, wherein the outlet tube comprises at least one external tooth that projects in such a manner as to allow in use said outlet tube to be pressed against a neck of the receiving container or tank and thus to cause the outlet tube to slide relative to the inlet tube and the valve system to open while also helping to support the weight of the liquid-storage container to which the pouring spout is connected;

sealing means to make the outlet and inlet tubes leak-proof; and a cap fitting onto an outlet exit portion of the outlet tube and optionally onto the inlet tube in order to prevent dust or dirt from entering the pouring spout.

12. The pouring spout according to claim 9, wherein the valve system first partially opens the liquid duct and then opens the air duct.

13. A pouring spout for a liquid-storage container, the pouring spout comprising:

an inlet tube detachably connectable to the liquid-storage container;

an outlet tube slideably connected to the inlet tube for guiding a liquid from the inlet tube to a receiving container or tank;

a liquid duct that is part of both the inlet tube and the outlet tube and through which the liquid can flow out of the liquid-storage container;

an air duct that is part of both the inlet tube and the outlet tube and through which air can enter the liquid-storage container;

a valve system for opening the liquid duct and the air duct when the outlet tube is slideably moved relative to the inlet tube, the valve system separately opening the liquid duct and the air duct into the liquid-storage container; and an internal spring keeping the valve system into a closed position unless the outlet tube is slideably moved relative to the inlet tube;

wherein the outlet tube is slideably mounted internally within the inlet tube and comprises an inlet portion which is devised so as to act as said valve system, said inlet portion comprising a valve head that externally projects from said inlet portion so as to come into contact with the outlet tube when the pouring spout is closed, said valve head being itself closed by an end wall so as to complete the closing of the pouring spout, said inlet portion acting as said valve system also comprising a hole made into the outlet tube close to the valve head so as to give access to the air duct integrated to said outlet tube, and one or more other holes also made close to the valve head so as to give separate access to the liquid duct also integrated to said outlet tube, said holes opening the air duct and the liquid duct when the outlet tube is pushed back within the inlet tube.

14. The pouring spout according to claim 13, further comprising:

a child-proof security system that has to be deactivated in order to allow the outlet tube to slide relative to the inlet tube and thus to open the valve system, wherein the outlet tube comprises at least one external tooth that projects in such a manner as to allow in use said outlet tube to be pressed against a neck of the receiving container or tank and thus to cause the outlet tube to slide relative to the inlet tube and the valve system to open while also helping to support the weight of the liquid-storage container to which the pouring spout is connected;

sealing means to make the outlet and inlet tubes leak-proof; and a cap fitting onto an outlet exit portion of the outlet tube and optionally onto the inlet tube in order to prevent dust or dirt from entering the pouring spout.

15. The pouring spout according to claim 13, wherein the valve system first partially opens the liquid duct and then opens the air duct.

* * * * *